US010233782B2

(12) United States Patent
Stafford

(10) Patent No.: US 10,233,782 B2
(45) Date of Patent: Mar. 19, 2019

(54) TURBINE ASSEMBLY AND METHOD FOR FLOW CONTROL

(71) Applicant: Solar Turbines Incorporated, San Diego, CA (US)

(72) Inventor: Scott L. Stafford, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 408 days.

(21) Appl. No.: 15/227,194

(22) Filed: Aug. 3, 2016

(65) Prior Publication Data

US 2018/0038239 A1 Feb. 8, 2018

(51) Int. Cl.

| | |
|---|---|
| ***F01D 5/02*** | (2006.01) |
| ***F01D 5/12*** | (2006.01) |
| ***F01D 9/04*** | (2006.01) |
| ***F01D 17/12*** | (2006.01) |
| ***F01D 25/24*** | (2006.01) |
| ***F01D 17/16*** | (2006.01) |

(52) U.S. Cl.

CPC ..... *F01D 25/246* (2013.01); *F01D 9/041* (2013.01); *F01D 17/167* (2013.01); *F05D 2220/40* (2013.01); *F05D 2270/80* (2013.01)

(58) Field of Classification Search

CPC ... F01D 5/02; F01D 5/12; F01D 9/041; F01D 17/12; F01D 25/246; F05D 2220/20; F05D 2220/40; F05D 2240/128; F05D 2240/35; F05D 2270/80

See application file for complete search history.

(56) References Cited

U.S. PATENT DOCUMENTS

| | | | | |
|---|---|---|---|---|
| 2,739,782 A | | 3/1956 | White | |
| 3,495,921 A | | 2/1970 | Swearingen | |
| 3,843,279 A | * | 10/1974 | Crossley | F01D 9/042 415/138 |
| 4,013,377 A | * | 3/1977 | Amos | F01D 17/162 415/161 |
| 4,502,836 A | | 3/1985 | Swearingen | |
| 4,558,987 A | * | 12/1985 | Dittie | F01D 5/146 415/162 |
| 4,579,507 A | * | 4/1986 | Corrigan | F01D 17/141 415/150 |

(Continued)

FOREIGN PATENT DOCUMENTS

| | | |
|---|---|---|
| GB | 2434414 | 4/2008 |

*Primary Examiner* — Igor Kershteyn
(74) *Attorney, Agent, or Firm* — James R. Smith

(57) ABSTRACT

A turbine assembly of an engine is disclosed. The turbine assembly includes a nozzle ring for receiving exhaust gases from a combustion chamber having a plurality of guide vanes for guiding the exhaust gases, a stator ring disposed downstream to the nozzle ring, and a rotor disposed circumferentially within the stator ring. The stator ring includes a plurality of stator vanes adapted to receive the exhaust gases through the guide vanes of the nozzle ring. The stator ring is axially movable between a first position and a second position along at least one cross-key pin disposed between the stator ring and a turbine casing. Each of the plurality of stator vanes moves into a throat plane of each pair of the plurality of guide vanes in the first position of the stator ring, and moves out of the throat plane in the second position of the stator ring.

20 Claims, 10 Drawing Sheets

(56) References Cited

U.S. PATENT DOCUMENTS

| | | | | |
|---|---|---|---|---|
| 4,874,289 | A * | 10/1989 | Smith, Jr. | F04D 29/563 415/150 |
| 5,236,307 | A * | 8/1993 | Ng | F01D 5/146 415/148 |
| 5,269,651 | A | 12/1993 | Ostermeir et al. | |
| 5,769,602 | A | 6/1998 | Agahi et al. | |
| 6,910,855 | B2 * | 6/2005 | Dailey | F01D 5/146 415/151 |
| 7,549,839 | B2 * | 6/2009 | Carroll | F01D 5/148 415/161 |
| 7,594,403 | B2 | 9/2009 | Cadieux | |
| 8,202,043 | B2 * | 6/2012 | McCaffrey | F01D 17/162 415/160 |
| 2013/0302147 | A1 | 11/2013 | Black et al. | |
| 2016/0010590 | A1 | 1/2016 | Rolt | |

* cited by examiner

TURBINE ASSEMBLY AND METHOD FOR FLOW CONTROL

TECHNICAL FIELD

The present disclosure relates to turbine assemblies and more particularly, to an axial flow turbine assembly and a method for controlling flow of exhaust gases in an engine.

BACKGROUND

Usually turbine assemblies, radial or axial, include a wheel with an annular inlet surrounding the wheel. The annular inlet is provided for introducing a pressurized fluid into a turbine assembly. In order to ensure a specific velocity distribution of the pressurized fluid in the turbine assembly, fixed guide vanes are disposed about the annular inlet forming a nozzle therebetween. The guide vanes may be movable to enable variable flow through the nozzles. The pressurized fluid coming through the nozzles may pass through stator vanes before finally impacting rotor blades.

A typical variable geometry system employs individual stator vanes, each of which rotate on a shaft. A plurality of shafts penetrates a turbine casing to be coupled with an actuation system, such as an actuation ring disposed external to the turbine assembly. The actuation ring must rotate the stator vanes in conjunction with each other with close precision. Due to the plurality of shafts moving with respect to the turbine casing, sealing between the plurality of shafts and the turbine casing is a significant concern during the operation of the turbine assembly. Further, usually, the actuation system for operating the plurality of shafts to in turn move the stator vanes includes a number of moving parts. An increased number of moving parts results into a difficulty in ensuring a precise rotation of the stator vanes. Furthermore, a thermal growth differential between the internally rotating stator vanes and the actuation system poses mechanical challenges.

Moreover, an efficiency of the turbine assembly is dependent on the velocity, direction, and mass flow of the fluid on the rotor blades. A change in ambient temperature affects air density and therefore, mass flow of exhaust gases through the turbine assembly. The mass flow through the turbine assembly in turn affects the velocity of the exhaust gases through the nozzles onto the rotor blades. For example, on a hot day, air density is reduced, mass flow is less and therefore, the velocity through the fixed guide vanes is less. Consequently, the velocity of the exhaust gases exiting the guide vanes and moving past the rotor blades is reduced, which is undesirable. Therefore, to maintain an optimum efficiency of the turbine assembly, it is desirable to implement a variable geometry nozzle that can maintain a specific velocity and direction, even if the turbine assembly operates in low or high-ambient air temperatures.

U.S. Pat. No. 5,769,602 (the '602 patent) discloses an automatic control of clamping forces in primary nozzle systems of radial turbines. Pressure to a closed annular volume positioned between a turbine housing and an axially adjustable mounting ring is varied to regulate the clamping forces against inlet vanes which form primary nozzles. A controller compares process control data with a signal indicative of operational deviation from nominal operation as indicated by the process control signal to detect onset of excessive blow-by, in which case pressure is increased in the closed annular volume to move the mounting rings closer together. The controller also compares expected and actual system data to detect onset of excessive clamping, in which case, pressure is increased in the closed annular volume to increase clamping forces. However, the '602 patent discloses a system that offers a fragmented and a relatively complicated approach for controlling flow of fluid in the radial turbines.

SUMMARY OF THE DISCLOSURE

In one aspect of the present disclosure, a turbine assembly of an engine is provided. The turbine assembly includes a nozzle ring adapted to receive exhaust gases from a combustion chamber of the engine. The nozzle ring includes a plurality of guide vanes disposed along a circumference of the nozzle ring for guiding the exhaust gases. The turbine assembly includes a stator ring disposed downstream to the nozzle ring. The stator ring including a plurality of stator vanes, disposed circumferentially along an inner surface of the stator ring, adapted to receive the exhaust gases through the guide vanes of the nozzle ring. The stator ring is axially movable between a first position and a second position along at least one cross-key pin disposed between an outer surface of the stator ring and an inner surface of a turbine casing. Each of the plurality of stator vanes moves into a throat plane of each pair of the plurality of guide vanes in the first position of the stator ring, and moves out of the throat plane in the second position of the stator ring. The turbine assembly includes a rotor, disposed circumferentially within the stator ring, adapted to receive the exhaust gases from the stator ring. The rotor includes a plurality of rotor blades disposed circumferentially along an outer surface of the rotor.

In another aspect of the present disclosure, a turbine assembly of an engine is disclosed. The turbine assembly includes a nozzle ring adapted to receive exhaust gases from a combustion chamber of the engine. The nozzle ring includes a plurality of guide vanes disposed along a circumference of the nozzle ring for guiding the exhaust gases. The turbine assembly includes a stator ring, disposed downstream to the nozzle ring, having a plurality of stator vanes disposed circumferentially along an inner surface of the stator ring adapted to receive the exhaust gases through the guide vanes of the nozzle ring. The stator ring is axially movable between a first position and a second position along at least one cross-key pin disposed between an outer surface of the stator ring and an inner surface of a turbine casing. The stator ring moves towards the nozzle ring in the first position and moves away from the nozzle ring in the second position. The turbine assembly includes a rotor, disposed circumferentially within the stator ring, adapted to receive the exhaust gases from the stator ring. The rotor includes a plurality of rotor blades disposed circumferentially along an outer surface of the rotor. The turbine assembly includes at least one pressure sensor adapted to detect a first pressure of the exhaust gases when the exhaust gases are between the nozzle ring and the stator ring, and a second pressure of the exhaust gases when the exhaust gases are between the stator ring and the rotor. The turbine assembly includes a controller, in communication with the at least one pressure sensor and the stator ring, adapted to control the axial movement of the stator ring between the first position and the second position, based on the first pressure and the second pressure of the exhaust gases.

In yet another aspect of the present disclosure, a method for controlling flow of exhaust gases through a turbine assembly of an engine is disclosed. The method includes receiving by a controller, a first pressure of exhaust gases between a nozzle ring and a stator ring of the turbine assembly and a second pressure of the exhaust gases between the stator ring and a rotor of the turbine assembly. The method includes receiving, by the controller, at least one value of one or more parameters pertaining to ambient air conditions. The method includes regulating, by the controller, the second pressure of the exhaust gases based on the first pressure of the exhaust gases and the at least one value of the one or more parameters. The method includes controlling, by the controller, an axial movement of the stator ring between a first position and a second position, based on the regulation of the second pressure. The axial movement of the stator ring is along at least one cross-key pin which is disposed between an outer surface of the stator ring and an inner surface of a turbine casing. The stator ring moves towards the nozzle ring in the first position and moves away from the nozzle ring in the second position for controlling the flow of exhaust gases through the turbine assembly.

Other features and aspects of this disclosure will be apparent from the following description and the accompanying drawings.

DETAILED DESCRIPTION

Figure 1:
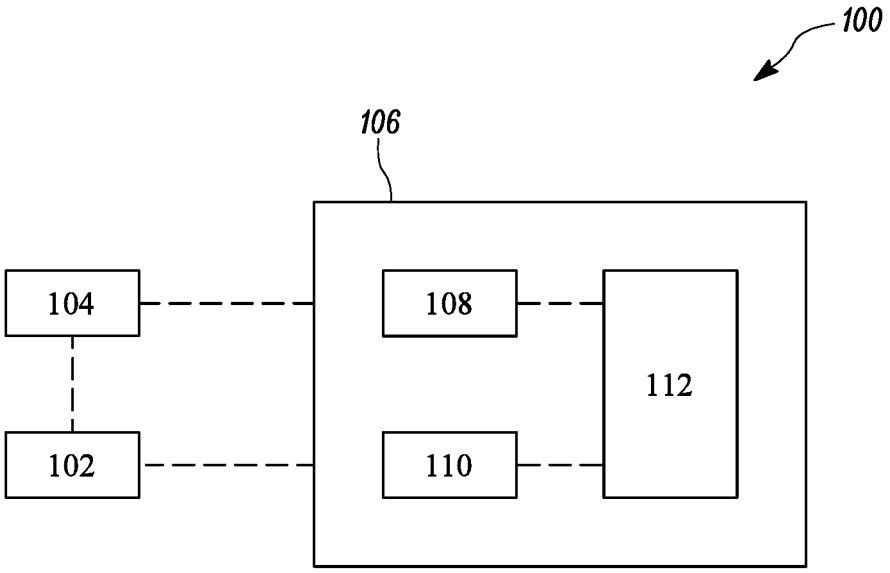
FIG. 1 is a block diagram of a turbine assembly, according to one embodiment of the present disclosure.

Wherever possible, the same reference numbers will be used throughout the drawings to refer to the same or the like parts. FIG. 1 illustrates a block diagram of a turbine assembly 100, according to one embodiment of the present disclosure. In the present embodiment, the turbine assembly 100 is an axial flow turbine assembly. The turbine assembly 100 may be utilized for controlling flow of exhaust gases in a turbine 104. In one embodiment, the turbine assembly 100 may be understood as a turbo-charger of the engine disposed upstream to an after-treatment system (not shown). In another embodiment, the turbine assembly 100 may be disposed in a turbine engine (not shown).

An air-fuel mixture may pass through a compressor 102 before entering a combustion chamber (not shown) through an intake manifold (not shown). In the combustion chamber, the air-fuel mixture may be combusted and consequently, exhaust gases may be generated within the combustion chamber. From the combustion chamber, the exhaust gases may be delivered to the turbine 104 of the turbine assembly 100 through an exhaust conduit (not shown).

The turbine assembly 100 of the present disclosure includes the compressor 102, the turbine 104 fluidly coupled to the compressor 102, and a flow control system 106 in communication with the compressor 102 and the turbine 104. The turbine 104 includes a nozzle ring 202 (shown in FIG. 2), a stator ring 204 (shown in FIG. 2) disposed downstream to the nozzle ring 202, and a rotor 206 (shown in FIG. 2) disposed downstream to the stator ring 204. The constructional and operational details of the turbine 104 are disclosed in the description of FIG. 2.

The flow control system 106 includes at least one pressure sensor 108 for determining pressure of the exhaust gases in the turbine 104, a set of sensors 110 for determining ambient conditions, and a controller 112 in communication with the at least one pressure sensor 108 and the set of sensors 110.

Figure 2:
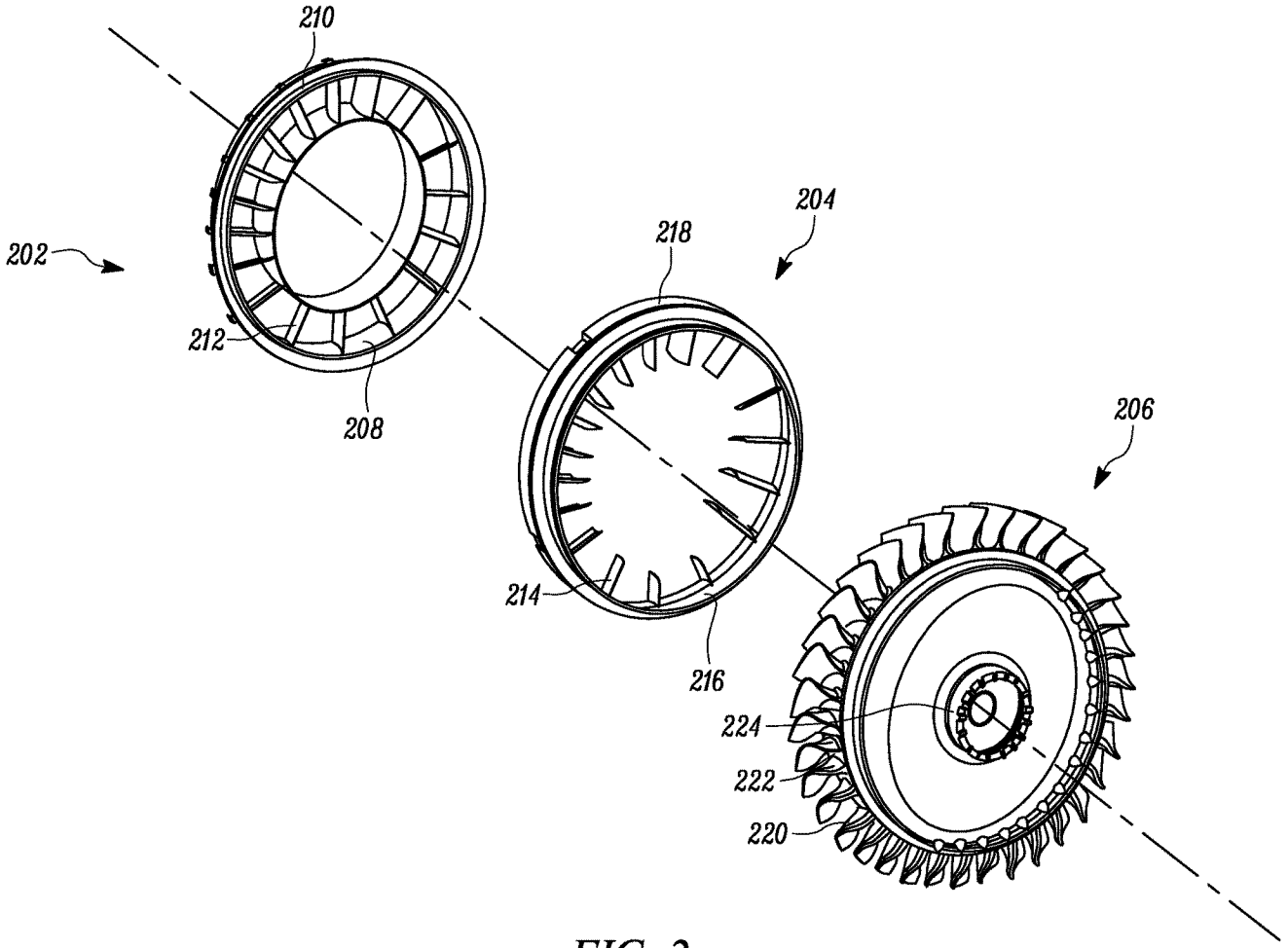
FIG. 2 is a perspective view of a nozzle ring, a stator ring, and a rotor of the turbine assembly, according to one embodiment of the present disclosure.

FIG. 2 illustrates a perspective view of the nozzle ring 202, the stator ring 204, and the rotor 206 of the turbine assembly 100, according to one embodiment of the present disclosure. The nozzle ring 202 may be adapted to receive the exhaust gases from the combustion chamber of the engine through the exhaust conduit. The nozzle ring 202 includes an inner surface 208 and an outer surface 210 radially distant from the inner surface 208. The nozzle ring 202 includes a plurality of guide vanes 212, individually referred to as the guide vane 212, disposed along a circumference of the nozzle ring 202. The plurality of guide vanes 212 may guide the exhaust gases received from the combustion chamber towards the stator ring 204. In the illustrated embodiment, the plurality of guide vanes 212 is disposed along the inner surface 208 of the nozzle ring 202. In another embodiment, the plurality of guide vanes 212 may be disposed along the outer surface 210 of the nozzle ring 202, without departing from the scope of the present disclosure.

After passing through the nozzle ring 202, the exhaust gases may impact the stator ring 204 which is disposed downstream to the nozzle ring 202. In the illustrated embodiment, the stator ring 204 includes a plurality of stator vanes 214, individually referred to as the stator vane 214, disposed circumferentially along an inner surface 216 of the stator ring 204. The plurality of stator vanes 214 may be adapted to receive the exhaust gases through the plurality of guide vanes 212 of the nozzle ring 202. In another embodiment, the plurality of stator vanes 214 may be disposed circumferentially along an outer surface 218 of the stator ring 204, without departing from the scope of the present disclosure.

In one embodiment, the rotor 206 may be circumferentially disposed within the stator ring 204. In another embodiment, the rotor 206 may be disposed downstream to the stator ring 204, without departing from the scope of the present disclosure. The rotor 206 may be adapted to receive the exhaust gases from the stator ring 204. The rotor 206 includes a plurality of rotor blades 220, individually referred to as the rotor blade 220, disposed circumferentially along an outer surface 222 of the rotor 206. In another embodiment, the plurality of rotor blades 220 may be disposed circumferentially along an inner surface 224 of the rotor 206, without departing from the scope of present disclosure. The impact of the exhaust gases on the plurality of rotor blades 220 results into a rotation of the rotor 206 which would further be transmitted to another component (not shown) through a drive shaft (not shown) for generation of power. In one embodiment, the turbine assembly 100 further includes a support ring 225 (shown in FIG. 3) disposed between the stator ring 204 and the rotor 206. The support ring 225 is disposed in such a manner that a cavity 227 is formed between the stator ring 204 and the support ring 225.

The turbine assembly 100 further includes a turbine casing 302 (shown in FIG. 3) for housing the nozzle ring 202, the stator ring 204, and the rotor 206. With respect to the turbine casing 302, the stator ring 204 is axially movable between a first position and a second position. In the first position, the stator ring 204 moves towards the nozzle ring 202. In the second position, the stator ring 204 moves away from the nozzle ring 202. The axial movement of the stator ring 204 is enabled by at least one cross-key pin 304 (shown in FIG. 3) disposed between the outer surface 218 of the stator ring 204 and an inner surface 306 of the turbine casing 302. The details of the movement of the stator ring 204 are disclosed in the description in the FIG. 3, FIG. 4, FIG. 5, FIG. 6, FIG. 7, and FIG. 8.

Figure 3:
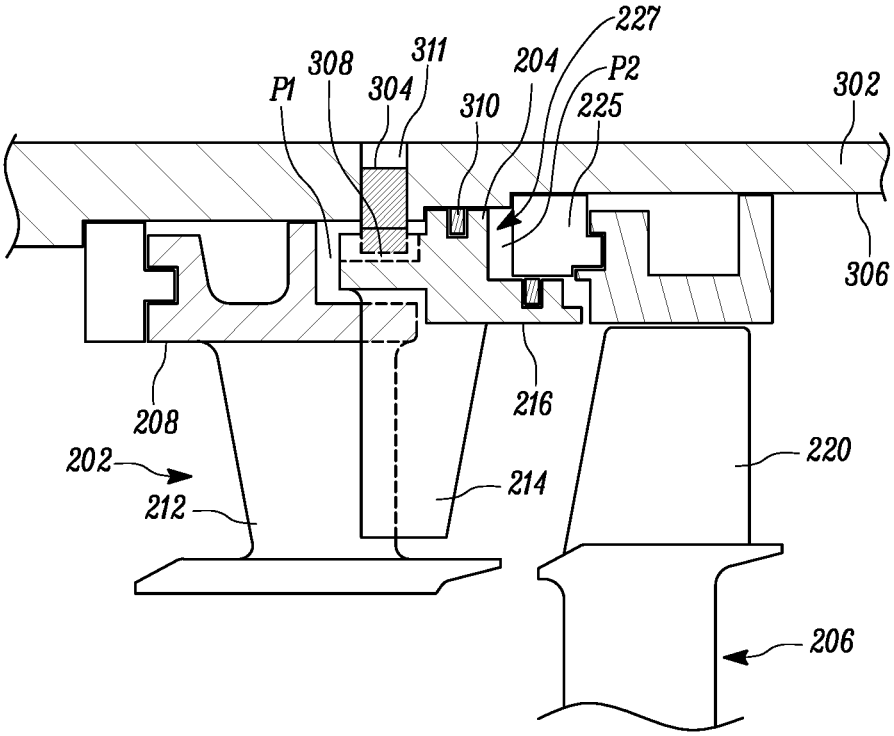
FIG. 3 is a sectional view of a guide vane, a stator vane, and a rotor blade of the nozzle ring, the stator ring, and the rotor, respectively, of the turbine assembly, according to one embodiment of the present disclosure.

FIG. 3 illustrates a sectional view of the guide vane 212 of the plurality of guide vanes 212, the stator vane 214 of the plurality of stator vanes 214, and a rotor blade 220 of the plurality of rotor blades 220, according to one embodiment of the present disclosure. As shown, the stator ring 204 and the turbine casing 302 are in engagement with each other through the at least one cross-key pin 304.

In the illustrated embodiment, the at least one cross-key pin 304 is coupled to the inner surface 306 of the turbine casing 302. In order to accommodate the at least one cross-key pin 304, the stator ring 204 includes at least one slot 308 on the outer surface 218. Therefore, when engaged, the at least one slot 308 accommodates the at least one cross-key pin 304 coupled to the inner surface 306 of the turbine casing 302. In another embodiment, the at least one cross-key pin 304 may be disposed on the outer surface 218 of the stator ring 204. In such an embodiment, the turbine casing 302 may include at least one hole 311 on the inner surface 306 to retain a cross-key pin 304, which engages the stator ring 204.

The turbine assembly 100 further includes at least one seal 310 disposed between the inner surface 306 of the turbine casing 302 and the outer surface 218 of the stator ring 204. In one embodiment, the seal 310 may be a piston seal ring 310. The at least one seal 310 is adapted to maintain a second pressure "P2" of the exhaust gases between the stator ring 204 and the rotor 206. In one embodiment, the second pressure "P2" may be understood as the pressure of the exhaust gases between the stator ring 204 and the support ring 225.

Figure 4:
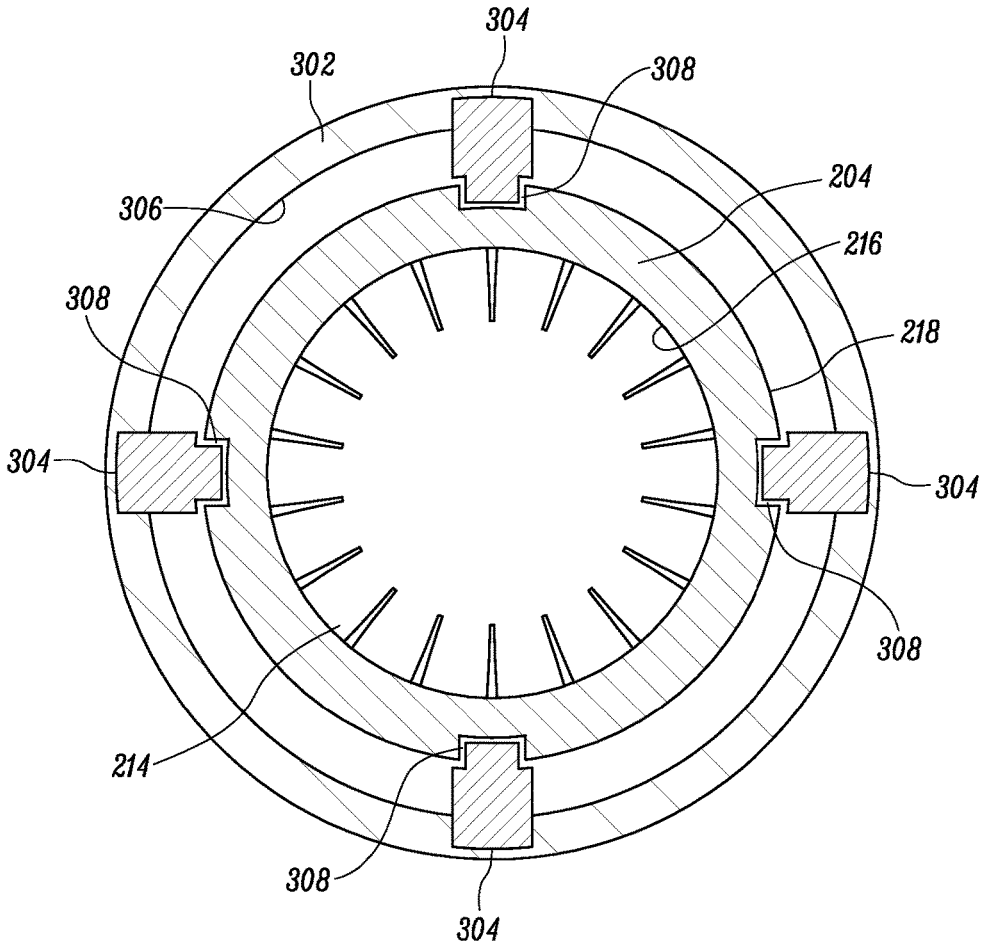
FIG. 4 is an axial view of the stator ring in engagement with a turbine casing through a plurality of cross-key pins, according to one embodiment of the present disclosure.

In the present embodiment, the stator ring 204 engages with the turbine casing 302 for the axial movement through four cross-key pins 304. FIG. 3 illustrates the engagement of the stator ring 204 with the turbine casing 302 through one of the four cross-key pins 304. FIG. 4 illustrates an axial view of the stator ring 204 in engagement with the turbine casing 302 through the four cross-key pins 304, according to one embodiment of the present disclosure. In the present embodiment, the four cross-key pins 304 and the corresponding four slots 308 are positioned equally spaced apart along the circumference of the turbine casing 302 and the stator ring 204, respectively. The number, positioning and dimensions of the at least one cross-key pin 304 and the at least one slot 308 may depend on operational and dimensional characteristics of the turbine 104. Therefore, in other embodiments, the number, the positioning, and the dimensions of the at least one cross-key pin 304 and the at least one slot 308 may vary from the illustrated embodiment, without departing from the scope of the present disclosure.

Figure 5:
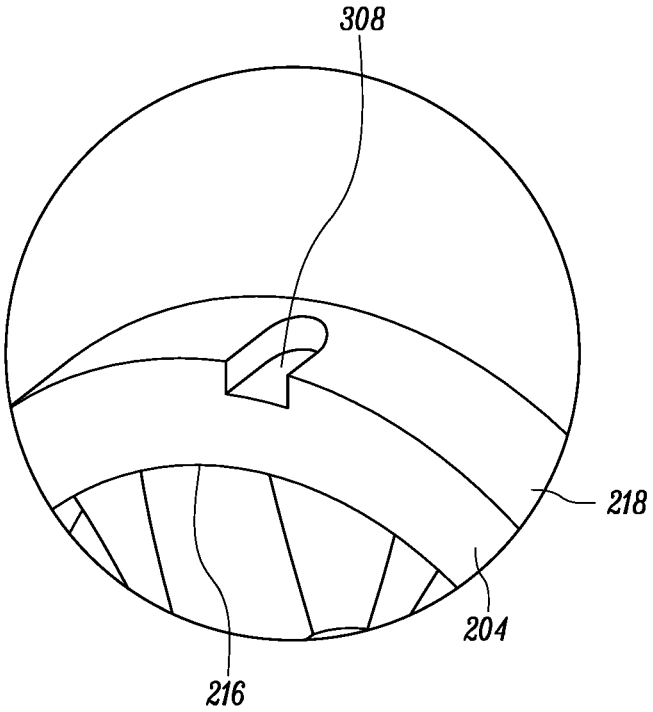
FIG. 5 is an enlarged view of a slot formed on a stator ring for accommodating a cross-key pin, according to one embodiment of the present disclosure.
Figure 6:
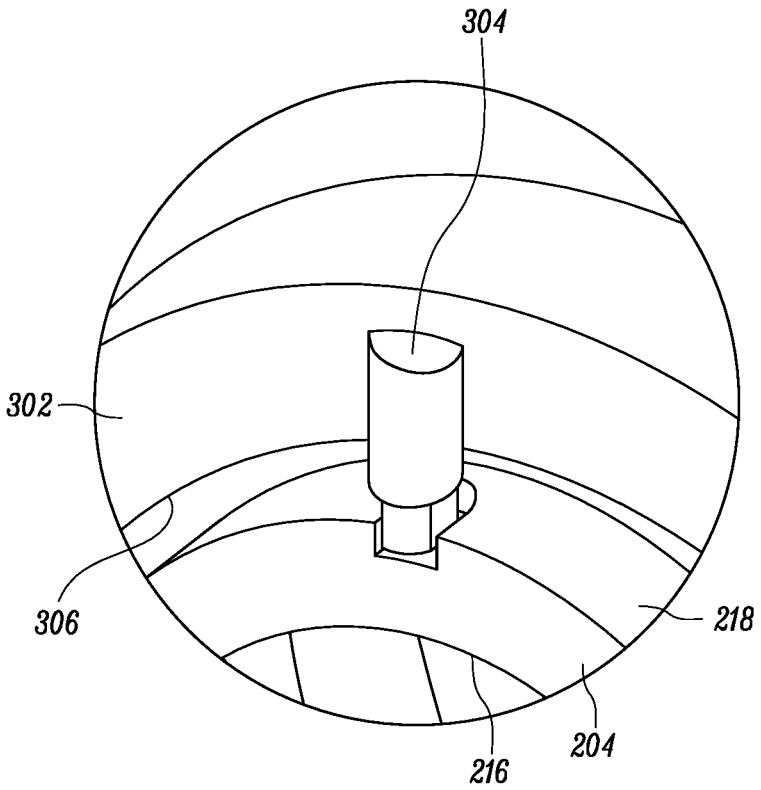
FIG. 6 is an enlarged view of the cross-key pin accommodated within the slot for engaging a turbine casing and the stator ring, according to one embodiment of the present disclosure.

FIG. 5 illustrates an enlarged view of the at least one slot 308 formed on the outer surface 218 of the stator ring 204, according to one embodiment of the present disclosure. The at least one slot 308 may be understood as a slot for accommodating the at least one cross-key pin 304 for enabling the axial movement of the stator ring 204 with respect to the turbine casing 302. FIG. 6 illustrates an enlarged view of the at least one cross-key pin 304 in engagement with the at least one slot 308, according to one embodiment of the present disclosure.

Figure 7:
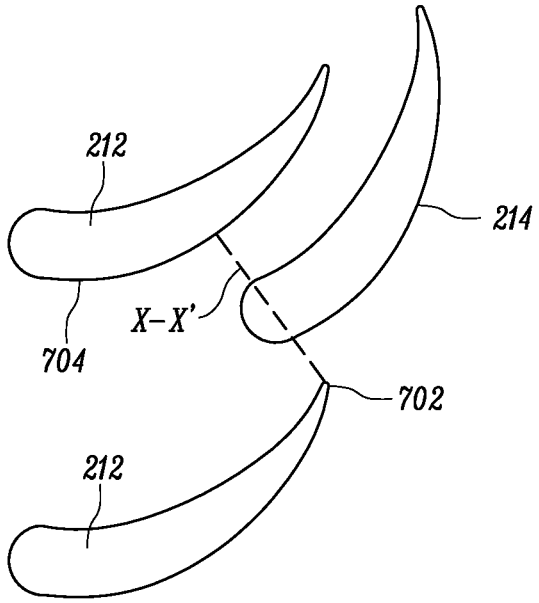
FIG. 7 is a schematic view of a pair of guide vanes and a stator vane in a first position of the stator ring, according to one embodiment of the present disclosure.

FIG. 7 illustrates a schematic view of a pair of guide vanes 212 and a stator vane 214 in the first position of the stator ring 204, according to one embodiment of the present disclosure. As mentioned earlier, in the first position, the stator ring 204 moves towards the nozzle ring 202 by making a forward axial movement along the at least one cross-key pin 304 in the at least one slot 308. Therefore, each of the plurality of stator vanes 214 moves into a throat plane XX' of each pair of the plurality of guide vanes 212. The throat plane XX' may be understood as a smallest area section formed between a trailing edge 702 of the guide vane 212 and a convex flank 704 of an adjacent guide vane 212. In another embodiment, the throat plane XX' may be indicative of an aerodynamic region between the guide vanes 212 that controls the flow of exhaust gases through the nozzle ring 202. As shown, the stator vane 214 moves into the throat plane XX' of the pair of guide vanes 212. As a result, the flow of exhaust gases through the plurality of guide vanes 212 is blocked.

Figure 8:
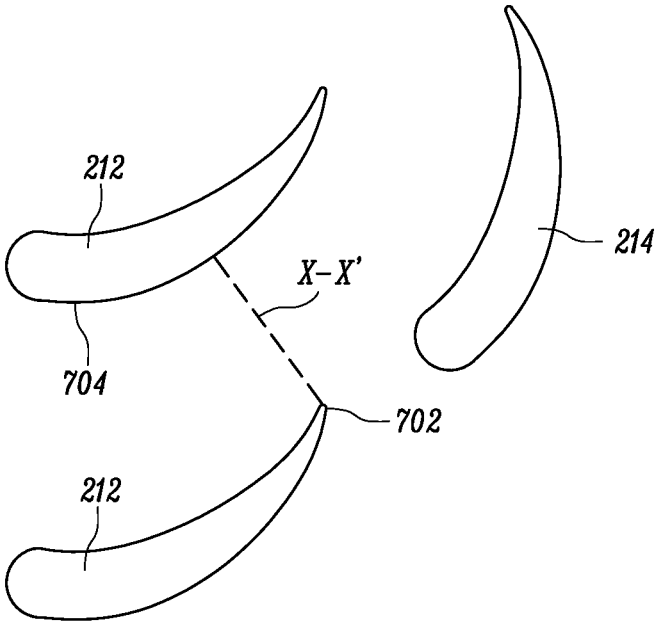
FIG. 8 is a schematic view of the pair of guide vanes and the stator vane in a second position of the stator ring, according to one embodiment of the present disclosure.

FIG. 8 illustrates a schematic view of the pair of guide vanes 212 and the stator vane 214 in the second position of the stator ring 204, according to one embodiment of the present disclosure. As mentioned earlier, in the second position, the stator ring 204 moves away from the nozzle ring 202 by making a rearward axial movement along the at least one cross-key pin 304 in the at least one slot 308. Therefore, each of the plurality of stator vanes 214 moves out of the throat plane XX' of each pair of the plurality of guide vanes 212. As shown, the stator vane 214 moves out of the throat plane XX' of the pair of guide vanes 212. As a result, the flow of exhaust gases through the plurality of guide vanes 212 is unblocked.

The turbine 104 may be in an operable communication with the flow control system 106. Referring back to FIG. 1, the at least one pressure sensor 108 is adapted to detect a first pressure "P1" of the exhaust gases when the exhaust gases are between the nozzle ring 202 and the stator ring 204. The at least one pressure sensor 108 is further adapted to detect the second pressure "P2" of the exhaust gases when the exhaust gases are between the stator ring 204 and the rotor 206. In one embodiment, the flow control system 106 may include two pressure sensors 108, one for detecting each of the first pressure "P1" and the second pressure "P2". In one embodiment, one of the two pressure sensors 108 may be disposed between the nozzle ring 202 and the stator ring 204 whereas the other pressure sensor 108 may be disposed between the stator ring 204 and the rotor 206. In another embodiment, the flow control system 106 may include one pressure sensor 108 for detecting the first pressure "P1" and the second pressure "P2".

Further, the set of sensors 110 is adapted to detect at least one value of one or more parameters pertaining to ambient air conditions. The one or more parameters may be understood as environmental factors affecting the operation of the turbine 104. In one embodiment, the one or more parameters may include, but are not limited to, a temperature, a pressure, and humidity of the air surrounding the turbine assembly 100. In one example, the set of sensors 110 may include a thermocouple for measuring temperature of air entering through an inlet of the compressor 102.

The at least one pressure sensor 108 and the set of sensors 110 are in communication with the controller 112. The data as detected by the at least one pressure sensor 108 and the set of sensors 110 are forwarded to the controller 112. The controller 112 is adapted to control the axial movement of the stator ring 204 between the first position and the second position. In one embodiment, the controller 112 controls the axial movement of the stator ring 204 based on the first pressure "P1" and the second pressure "P2" of the exhaust gases. In another embodiment, the controller 112 controls the axial movement of the stator ring 204 based on the first pressure "P1", the second pressure "P2", and the at least one value of the one or more parameters. The constructional and operational details of the controller 112 are explained in the description of FIG. 9.

Figure 9:
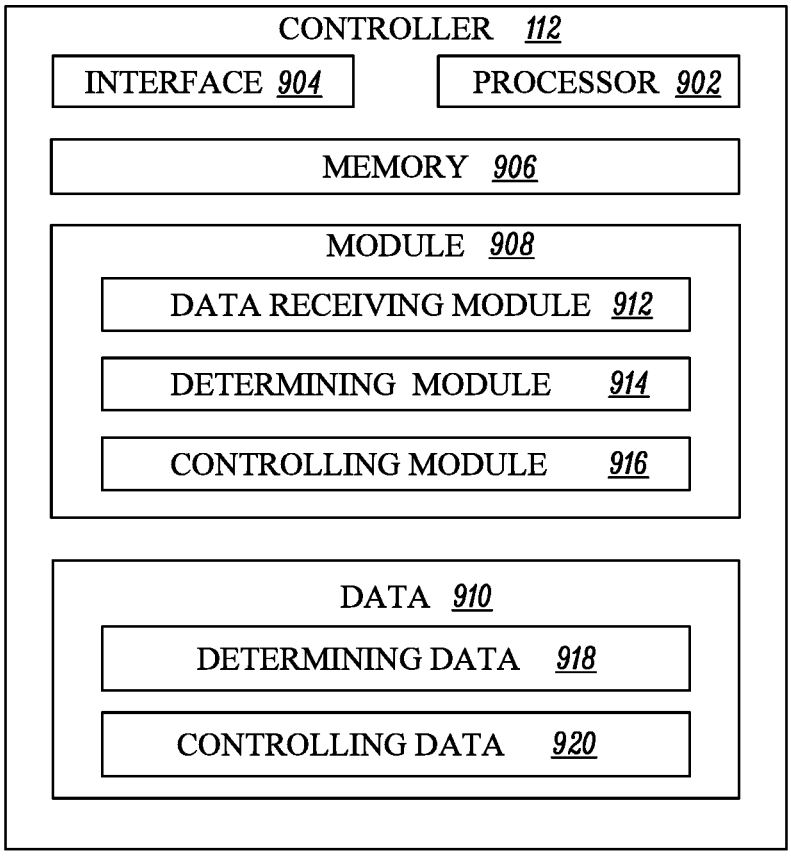
FIG. 9 is a block diagram of a controller of the turbine assembly, according to one embodiment of the present disclosure.

FIG. 9 illustrates a block diagram of the controller 112 of the turbine assembly 100, according to one embodiment of the present disclosure. The controller 112 includes a processor 902, an interface 904, and a memory 906 communicably coupled to the processor 902. The processor 902 may be configured to fetch and execute computer readable instructions stored in the memory 906. In one embodiment, the processor 902 may be implemented as one or more microprocessors, microcomputers, microcontrollers, digital signal processors, central processing units, state machine, logic circuitries or any devices that manipulate signals based on operational instructions.

The interface 904 may facilitate multiple communications within wide variety of protocols and networks, including wired network. Further, the interface 904 may include a variety of software and hardware interfaces. In another embodiment, the interface 904 may include, but is not limited to, peripheral devices, such as a keyboard, a mouse, an external memory, and a printer. The interface 904 may facilitate multiple communications within wide variety of protocols and networks, including wired network. In one example, the interface 904 may include one or more ports for connecting the controller 112 to an output unit (not shown).

In one embodiment, the memory 906 may include any non-transitory computer-readable medium. In one example, the non-transitory computer-readable medium may be a volatile memory, such as static random access memory and a non-volatile memory, such as read-only memory, erasable programmable ROM, and flash memory.

The controller 112 may also include modules 908 and data 910. The modules 908 include routines, programs, objects, components, and data structures, which perform particular tasks or implement particular abstract data types. In one embodiment, the modules 908 include a data receiving module 912, a determining module 914, and a controlling module 916. The data 910 may include a repository for storing data processed, received, and generated by one or more of the modules 908. The data 910 include a determining data 918 and a controlling data 920.

The data receiving module 912 receives the data as detected by the at least one pressure sensor 108. In the present embodiment, the data may include, but are not limited to, the first pressure "P1" of the exhaust gases between the nozzle ring 202 and the stator ring 204, and the second pressure "P2" of the exhaust gases between the stator ring 204 and the rotor 206. The first pressure "P1" may be understood as an operating pressure of the turbine 104. The data receiving module 912 also receives the data as detected by the set of sensors 110. The data may include, but are not limited to, the at least one value of the one or more parameters which correspond to the environmental factors. In one embodiment, the details pertaining to the data receiving module 912 may be stored in the determining data 918.

Upon receiving the data from the at least one pressure sensor 108 and the set of sensors 110 by the data receiving module 912, the determining module 914 determines a desired second pressure "P3" of the exhaust gases, based on the first pressure "P1" and the at least one value. Therefore, the desired second pressure "P3" may vary according to the operational pressure of the turbine 104 and the environmental factors. Based on the second pressure "P2" and the desired second pressure "P3", the determining module 914 determines whether the second pressure "P2" has to be increased or decreased to achieve the desired second pressure "P3". In one embodiment, details pertaining to the determining module 914 may be stored in the determining data 918.

Following the determination of whether the second pressure "P2" has to be increased or decreased to achieve the desired second pressure "P3", the controlling module 916 regulates the second pressure "P2". In other words, the controlling module 916 regulates the second pressure "P2" based on the first pressure "P1" and the at least one value of the one or more parameters. The controlling module 916 may control the second pressure "P2" by introducing air into the exhaust gases when the exhaust gases are between the stator ring 204 and the rotor 206. In one embodiment, the controlling module 916 may control the second pressure "P2" by introducing air into the cavity 227 between the stator ring 204 and the support ring 225.

In one embodiment, the air is drawn from the compressor 102 which is connected to the turbine 104 through a conduit (not shown). The conduit may be adapted to carry the air from the compressor 102 to the cavity 227 between the stator ring 204 and the support ring 225. The controlling module 916 may vary the second pressure "P2" by varying an amount of air to be introduced between the stator ring 204 and the support ring 225. In one embodiment, the amount of air from the compressor 102 to the turbine 104 may be controlled by a check valve (not shown) disposed in the conduit. In one example, in a closed state of the check valve, the second pressure "P2" may be less than the first pressure "P1" as a result of a normal pressure drop across the stator ring 204. In another example, in an open state of the check valve, the second pressure "P2" may be greater than the first pressure "P1". In another embodiment, the air may be drawn from a reservoir (not shown).

The axial movement of the stator ring 204 between the first position and the second position is controlled based on the regulation of the second pressure "P2" by the controlling module 916. In one embodiment, when the second pressure "P2" is greater than the first pressure "P1", the stator ring 204 achieves the first position by making the forward axial movement along the at least one cross-key pin 304. In another embodiment, when the second pressure "P2" is greater than the first pressure "P1", the stator ring 204 achieves the second position by making the rearward axial movement along the at least one cross-key pin 304. Therefore, the stator ring 204 is a pressure-activated stator ring 204 making axial movements along the at least one cross-key pin 304. In one embodiment, the seal 310 enables variable pressure across the stator ring 204 resulting into the axial movement of the stator ring 204. In one embodiment, details pertaining to the controlling module 916 may be stored in the controlling data 920.

INDUSTRIAL APPLICABILITY

The present disclosure relates to the turbine assembly 100 and a method 1000 of controlling flow of the exhaust gases in the engine. The turbine assembly 100 includes the nozzle ring 202 having the plurality of guide vanes 212, the stator ring 204 having the plurality of stator vanes 214, and the rotor 206 having the plurality of rotor blades 220. The stator ring 204 is axially movable between the first position and the second position, along the at least one cross-key pin 304 accommodated in the at least one slot 308 disposed between the turbine casing 302 and the stator ring 204. The axial movement of the stator ring 204 is based on the first pressure "P1" and the second pressure "P2". When the second pressure "P2" is greater than the first pressure "P1", the stator ring 204 achieves the first position by moving towards the nozzle ring 202. When the second pressure "P2" is less than the first pressure "P1", the stator ring 204 achieves the second position by moving away from the nozzle ring 202. The flow control system 106 of the turbine assembly 100 controls the second pressure "P2" based on the first pressure "P1" and the at least one value of the one or more parameters.

Although the turbine assembly 100 of the present embodiment is explained to be installed for controlling the flow of exhaust gases before being introduced into the after-treatment system of the engine, the scope of the present disclosure is not limited to such an application. The turbine assembly 100 can be employed in any application and any industry for the purpose of controlling flow of a fluid, without departing from the scope of the present disclosure.

Figure 10:
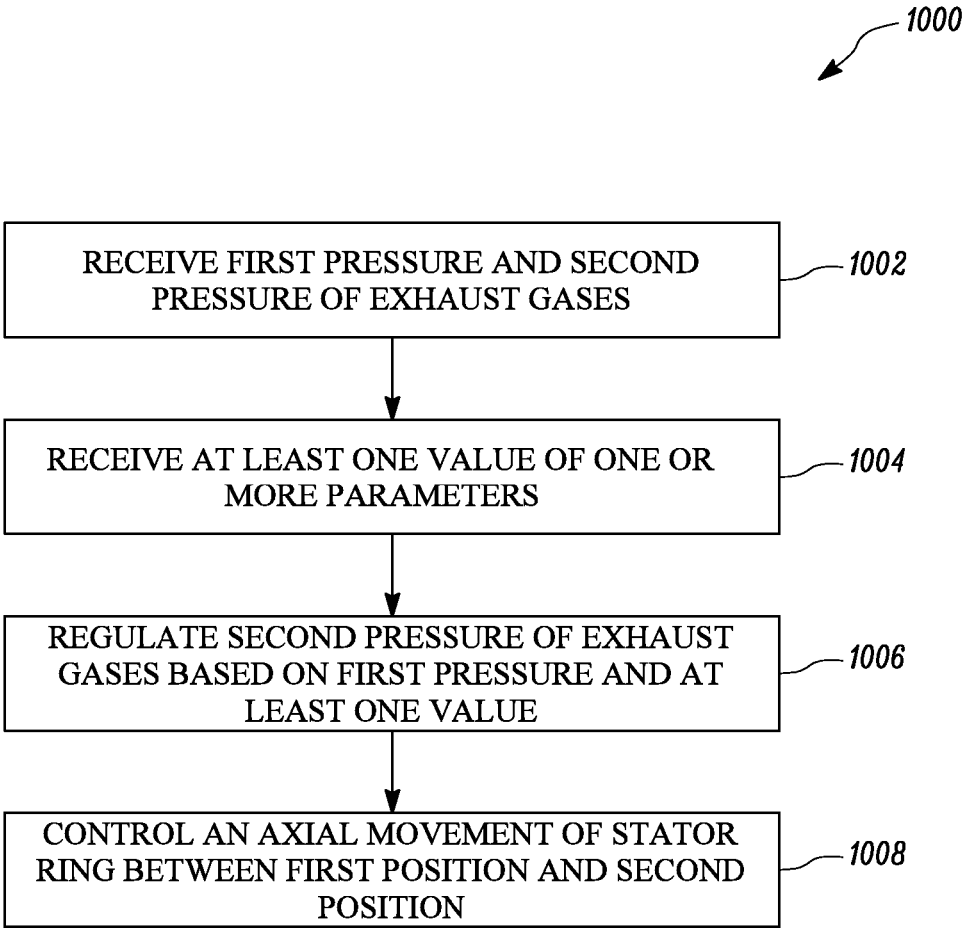
FIG. 10 is a flowchart of a method for controlling flow of the exhaust gases through the turbine assembly, according to one embodiment of the present disclosure.

FIG. 10 is a flowchart for the method 1000 for controlling flow of the exhaust gases through the turbine assembly 100, according to one embodiment of the present disclosure. For the sake of brevity, some aspects of the present disclosure which are already explained in detail in the description of FIG. 1, FIG. 2, FIG. 3, FIG. 4, FIG. 5, FIG. 6, FIG. 7, FIG. 8, and FIG. 9 are not explained in the description of FIG. 10.

At block 1002, the method 1000 includes receiving the first pressure "P1" and the second pressure "P2" of the exhaust gases. In one embodiment, the first pressure "P1" and the second pressure "P2" are detected by the at least one pressure sensor 202. In one embodiment, the data receiving module 912 of the controller 112 of the flow control system 106 receives the first pressure "P1" and the second pressure "P2" of the exhaust gases.

At block 1004, the method 1000 includes receiving the at least one value of the one or more parameters. The one or more parameters are indicative of environmental factors affecting the operation of the turbine 104 of the turbine assembly 100. The one or more parameters may include, but are not limited to, the temperature, the pressure, and humidity of the air surrounding the turbine assembly 100. In one embodiment, the at least one value is detected by the set of sensors 110. In one embodiment, the data receiving module 912 of the controller 112 of the flow control system 106 receives the at least one value of the one or more parameters.

At block 1006, the method 1000 includes regulating the second pressure "P2" based on the first pressure "P1" and the at least one least one value. The second pressure "P2' is regulated to achieve the desired second pressure "P3". In one embodiment, the second pressure "P2" may be regulated by drawing air into the cavity 227 between the stator ring 204 and the support ring 225 from the compressor 102. In one embodiment, the controlling module 916 of the controller 112 of the flow control system 106 may regulate the second pressure "P2" of the exhaust gases.

At block 1008, the method 1000 includes controlling the axial movement of the stator ring 204 between the first position and the second position. The axial movement is controlled based on the regulation of the second pressure "P2". The stator ring 204 makes the axial movement along the at least one cross-key pin 304 which is disposed between the outer surface 218 of the stator ring 204 and the inner surface 306 of the turbine casing 302. In the first position, the stator ring 204 moves towards the nozzle ring 202. In the second position, the stator ring 204 moves away from the nozzle ring 202. The axial movement of the stator ring 204 facilitates in controlling the flow of exhaust gases through the turbine assembly 100.

The turbine assembly 100 and the method 1000 of the present disclosure offer a comprehensive approach for controlling flow of the exhaust gases in the engine. The stator ring 204 of the turbine 104 of the turbine assembly 100 move axially with respect to the turbine casing 302 for blocking or releasing the flow of exhaust gases through the turbine 104. Since the turbine assembly 100 includes the stator ring 204 having the stator vanes 214, the requirement of multiple shafts for moving individual stator vanes is eliminated. As a result, cost and inconvenience pertaining to sealing between the multiple shafts and the turbine casing 302 are also eliminated. Further, the axially moveable stator ring 204 is completely internal to the turbine assembly 100 and can be designed to operate in a bimodal (open/closed) position without an external actuation mechanism. The absence of the external actuation mechanism for moving the stator vanes 214 lead to a significant reduction in the number of moving parts involved in turbine operation, thereby resulting into a simpler construction, simpler operation and less maintenance costs of the turbine assembly 100. Further, for enabling the axial movement of the stator ring 204, the at least one cross-key pin 304 and the at least one slot 308 are utilized. The at least one cross-key pin 304 is disposed between the stator ring 204 and the turbine casing 302 and is accommodated in the at least one slot 308 formed on the stator ring 204. The at least one cross-key pin 304 allows the axial movement of the stator ring 204 and in turn of the stator vanes 214 while accommodating differences in radial growth and maintaining position to a centerline of the turbine assembly 100.

In addition, the number, the dimension, and the positioning of the at least one cross-key pin 304 and the at least one slot 308 may be varied according to dimensional and operational characteristics of the turbine 104. Also, the operation of the turbine 104 may be varied based on the ambient air conditions by controlling the flow of exhaust gases in the turbine 104. This would ensure an effective operation of the turbine 104 in at least two conditions. Further, there is flexibility with regard to implementation and operation of the present invention resulting into a wide scope of application of the present disclosure.

Further, the axial movement of the stator ring 204 is enabled based on the first pressure "P1" and the second pressure "P2". The stator ring 204 of the present disclosure is pressure activated and move based on the pressure difference between the first pressure "P1" and the second pressure "P2". Therefore, the number of mechanical components disposed for the application of the present disclosure is minimal leading to a simple construction and operation of the turbine assembly 100. In addition, owing to simpler construction and easy operation, maintenance concerns are also minimal. Moreover, an overall operation cost of the turbine assembly 100 is significantly low. Therefore, the present disclosure offers the turbine assembly 100 and the method 1000 for controlling the flow of exhaust gases in the engine that are simple, effective, economical, flexible, and time saving.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A turbine assembly of an engine, the turbine assembly comprising:

a nozzle ring adapted to receive exhaust gases from a combustion chamber of the engine, the nozzle ring comprising a plurality of guide vanes disposed along a circumference of the nozzle ring for guiding the exhaust gases;

a stator ring disposed downstream to the nozzle ring, the stator ring comprising a plurality of stator vanes, disposed circumferentially along an inner surface of the stator ring, adapted to receive the exhaust gases through the plurality of guide vanes of the nozzle ring, the stator ring being axially movable between a first position and a second position along at least one cross-key pin disposed between an outer surface of the stator ring and an inner surface of a turbine casing, wherein each of the plurality of stator vanes moves into a throat plane of each pair of the plurality of guide vanes in the first position of the stator ring, and moves out of the throat plane in the second position of the stator ring; and a rotor, disposed circumferentially within the stator ring, adapted to receive the exhaust gases from the stator ring, wherein the rotor comprises a plurality of rotor blades disposed circumferentially along an outer surface of the rotor.

2. The turbine assembly of claim 1 comprising at least one pressure sensor adapted to detect a first pressure of the exhaust gases when the exhaust gases are between the nozzle ring and the stator ring, and a second pressure of the exhaust gases when the exhaust gases are between the stator ring and the rotor.

3. The turbine assembly of claim 2 comprising a controller, in communication with the at least one pressure sensor and the stator ring, adapted to control the axial movement of the stator ring between the first position and the second position, based on the first pressure and the second pressure of the exhaust gases.

4. The turbine assembly of claim 2 comprising a set of sensors adapted to detect at least one value of one or more parameters pertaining to ambient air conditions, wherein the one or more parameters include at least one of a temperature, a pressure, and humidity of the air surrounding the turbine assembly.

5. The turbine assembly of claim 4 comprising a controller, in communication with the at least one pressure sensor, the set of sensors, and the stator ring, adapted to control the axial movement of the stator ring between the first position and the second position, based on the first pressure and the second pressure of the exhaust gases, and the at least one value of the one or more parameters.

6. The turbine assembly of claim 2 comprising at least one seal, disposed between the stator ring and the turbine casing, adapted to maintain the second pressure between the stator ring and the rotor.

7. The turbine assembly of claim 1, wherein the stator ring comprises at least one slot adapted to accommodate the at least one cross-key pin coupled to the inner surface of the turbine casing.

8. A turbine assembly of an engine, the turbine assembly comprising:

a nozzle ring adapted to receive exhaust gases from a combustion chamber of the engine, the nozzle ring comprising a plurality of guide vanes disposed along a circumference of the nozzle ring for guiding the exhaust gases;

a stator ring, disposed downstream to the nozzle ring, comprising a plurality of stator vanes disposed circumferentially along an inner surface of the stator ring adapted to receive the exhaust gases through the guide vanes of the nozzle ring, the stator ring being axially movable between a first position and a second position along at least one cross-key pin disposed between an outer surface of the stator ring and an inner surface of a turbine casing, wherein the stator ring moves towards the nozzle ring in the first position and moves away from the nozzle ring in the second position;

a rotor, disposed circumferentially within the stator ring, adapted to receive the exhaust gases from the stator ring, wherein the rotor comprises a plurality of rotor blades disposed circumferentially along an outer surface of the rotor;

at least one pressure sensor adapted to detect a first pressure of the exhaust gases when the exhaust gases are between the nozzle ring and the stator ring, and a second pressure of the exhaust gases when the exhaust gases are between the stator ring and the rotor; and a controller, in communication with the at least one pressure sensor and the stator ring, adapted to control the axial movement of the stator ring between the first position and the second position, based on the first pressure and the second pressure of the exhaust gases.

9. The turbine assembly of claim 8 comprising a set of sensors adapted to detect at least one value of one or more parameters pertaining to ambient air conditions, wherein the one or more parameters include at least one of a temperature, a pressure, and humidity of the air surrounding the turbine assembly.

10. The turbine assembly of claim 9, wherein the controller is adapted to, receive, from the at least one pressure sensor, the first pressure and the second pressure of the exhaust gases;

receive, from the set of sensors, the at least one value of the one or more parameters;

regulate the second pressure of the exhaust gases based on the first pressure of the exhaust gases and the at least one value of the one or more parameters; and control the axial movement of the stator ring between the first position and the second position, based on the regulation of the second pressure.

11. The turbine assembly of claim 8, wherein the stator ring comprises at least one slot adapted to accommodate the at least one cross-key pin being coupled to the inner surface of the turbine casing.

12. The turbine assembly of claim 8 comprising at least one seal disposed between the stator ring and the turbine casing, adapted to maintain the second pressure between the stator ring and the rotor.

13. The turbine assembly of claim 12, wherein the at least one seal is a piston ring seal.

14. The turbine assembly of claim 8, wherein each of the plurality of stator vanes moves into a throat plane of each pair of the plurality of guide vanes in the first position of the stator ring.

15. The turbine assembly of claim 8, wherein each of the plurality of stator vanes moves out of a throat plane of each pair of the plurality of guide vanes in the second position of the stator ring.

16. A method for controlling flow of exhaust gases through a turbine assembly of an engine, the method comprising:

receiving, by a controller, a first pressure of exhaust gases between a nozzle ring and a stator ring of the turbine assembly and a second pressure of the exhaust gases between the stator ring and a rotor of the turbine assembly;

receiving, by the controller, at least one value of one or more parameters pertaining to ambient air conditions;

regulating, by the controller, the second pressure of the exhaust gases based on the first pressure of the exhaust gases and the at least one value of the one or more parameters; and controlling, by the controller, an axial movement of the stator ring between a first position and a second position, based on the regulation of the second pressure, the axial movement of the stator ring being along at least one cross-key pin which is disposed between an outer surface of the stator ring and an inner surface of a turbine casing, wherein the stator ring moves towards the nozzle ring in the first position and moves away from the nozzle ring in the second position for controlling the flow of exhaust gases through the turbine assembly.

17. The method of claim 16 comprising regulating, by the controller, the second pressure by drawing air, between the stator ring and the rotor, from a compressor.

18. The method of claim 16 comprising detecting, by at least one pressure sensor, the first pressure and the second pressure of the exhaust gases.

19. The method of claim 16 comprising detecting, by a set of sensors, the at least one value of the one or more parameters.

20. The method of claim 16, wherein the one or more parameters include at least one of a temperature, a pressure, and humidity of the air surrounding the turbine assembly.

* * * * *